US005857948A

United States Patent [19]

Barnett

[11] Patent Number: 5,857,948

[45] **Date of Patent: *Jan. 12, 1999**

[54] SELF-CONFORMABLE HEAD SUPPORT

[76] Inventor: Larry W. Barnett, 12 Nimrod Farm Rd., Weston, Conn. 06883

[ * ] Notice: This patent issued on a continued prosecution application filed under 37 CFR 1.53(d), and is subject to the twenty year patent term provisions of 35 U.S.C. 154(a)(2).

[21] Appl. No.: 564,601

[22] Filed: Nov. 29, 1995

Related U.S. Application Data

[63] Continuation-in-part of Ser. No. 401,218, Mar. 9, 1995, abandoned.

[51] Int. Cl.[6] ..... A63B 23/02; A61F 5/02

[52] U.S. Cl. ..... 482/140; 602/18; 5/644

[58] Field of Search ..... 482/140; 602/18; 5/644

[56] References Cited

U.S. PATENT DOCUMENTS

| | | | |
|---|---|---|---|
| 3,374,785 | 3/1968 | Gaylord | 602/18 |
| 4,011,611 | 3/1977 | Lederman . | |
| 4,099,523 | 7/1978 | Lowrey | 602/18 |
| 4,335,875 | 6/1982 | Elkin . | |
| 4,691,917 | 9/1987 | Battista . | |
| 4,863,158 | 9/1989 | Tassone . | |
| 4,958,631 | 9/1990 | Sarkozi | 602/18 |
| 5,056,508 | 10/1991 | Brunell | 602/18 |
| 5,169,372 | 12/1992 | Tecco . | |
| 5,209,712 | 5/1993 | Ferri . | |
| 5,267,931 | 12/1993 | Faetini . | |
| 5,295,949 | 3/1994 | Hathaway . | |
| 5,375,278 | 12/1994 | Van Winkle | 5/644 |

*Primary Examiner*—Richard J. Apley
*Assistant Examiner*—William LaMarca
*Attorney, Agent, or Firm*—St. Onge Steward Johnston & Reens LLC

[57] ABSTRACT

A cervical spine support is described for use in exercises such for abdominal muscle strengthening. The support is formed of a hollow elongate flexible bag which contains a conformable material such as a granular material selected for its ability to conform to the shape of a person's cervical spine. The granular material is capable of flowing during use so as to provide a surface support that is comfortable to the user. Other conformable materials can be used such as a gel or air.

14 Claims, 2 Drawing Sheets

SELF-CONFORMABLE HEAD SUPPORT

PRIOR APPLICATIONS

This application is a continuation in part of copending United States patent application entitled Self -Conformable Head Support filed Mar. 9, 1995 bearing Ser. No. 08/401,218 now abandoned in the United States Patent And Trademark Office.

FIELD OF THE INVENTION

This invention generally relates to a cervical support and more specifically to a cervical support for exercises to strengthen abdominal muscles.

BACKGROUND OF THE INVENTION

Devices for assisting a person for sit-up exercises are well known in the art. See for example U.S. Pat. Nos. 4,863,158 to Tassone; 5,122,107 to Gardner; 5,169,372 to Tecco and 5,267,931 to Faetini. The devices shown and described in these patents have shortcomings in the support of the head during a stomach muscle building exercise. The exercise bar shown in the Tassone patent employs a rigid neck bow that cannot comfortably adjust to a person's neck. The harness described in the Gardner patent employs a complex web of support straps using fixed width straps behind the neck and under the head.

The device shown in Tecco is also a rigid neck support which can, depending upon the selected embodiment be painful to use. The device described in the patent to Faetini uses a fixed contoured cervical support design to provide the desired neck support.

U.S. Pat. No. 5,295,949 describes a neck immobilizing elongate elastic neck band for rehabilitation of a neck injury. The neck band is resiliently stretchable and has a pocket to receive one of several types of inserts. The neck band is made with a stiffener whose function is to maintain a flat configuration for the neck band though the stiffeners will conform to the bend of the neck band around the neck of a person. The inserts are made of a semi-rigid pliable material which when placed within the pocket of the neck band immobilize the neck.

These prior art devices are in some cases somewhat painful to use and in others not sufficiently conforming to provide the desired comfort and ease of use as an abdominal muscle exercising support.

SUMMARY OF THE INVENTION

With a cervical spine support in accordance with the invention abdominal muscles can be conveniently exercised with a support that conforms to the shape of a person's neck to provide extended surface support independent of a person's neck and head shapes.

This is achieved with one cervical spine support in accordance with the invention by employing an elongate flexible bag which contains a conformable material and has a pair of flexible hand holds connected to end segments of the bag. The conformable material is selected so as to provide extended area support for the back of the head near the neck. The elongate hand holds may then be grasped by a person while the bag conforms to the cervical spine for comfortable neck and head support during abdominal exercises.

The bag as described in a preferred embodiment is packed with a granular material, which is selected so that it exhibits little compaction while allowing the material to adjust to the shape of the person's cervical spine. However other materials can be used such as a viscous gel capable of flowing to conform to the shape of the exerciser's cervical spine. A gaseous material such as air can be used in a personally inflatable cervical support.

With a cervical neck support in accordance with the invention the alignment of the spine and the natural shape of the lordosis of the cervical can be properly supported during an abdominal exercise without pain while providing the needed traction and counterbalance for sit ups without excessive use of neck muscles or heavy pulling on the back of the head. The invention improves abdominal exercises because it does not rely on chest muscles to assist in holding the head up and thus enables the exercise to concentrate the efforts on the abdominal muscles.

It is, therefore, an object of the invention to provide a comfortable support for the cervical spine for use during exercises such as sit-ups to strengthen abdominal muscles. It is a further object of the invention to provide a conforming cervical neck support for a person to reduce the strain on neck muscles and reduce pulling on the head during abdominal exercises.

These and other objects and advantages of the invention can be understood from the following detailed description of a preferred embodiment of the invention as shown in the drawings.

DETAILED DESCRIPTION OF THE DRAWINGS

Figures 1, 2, 3:
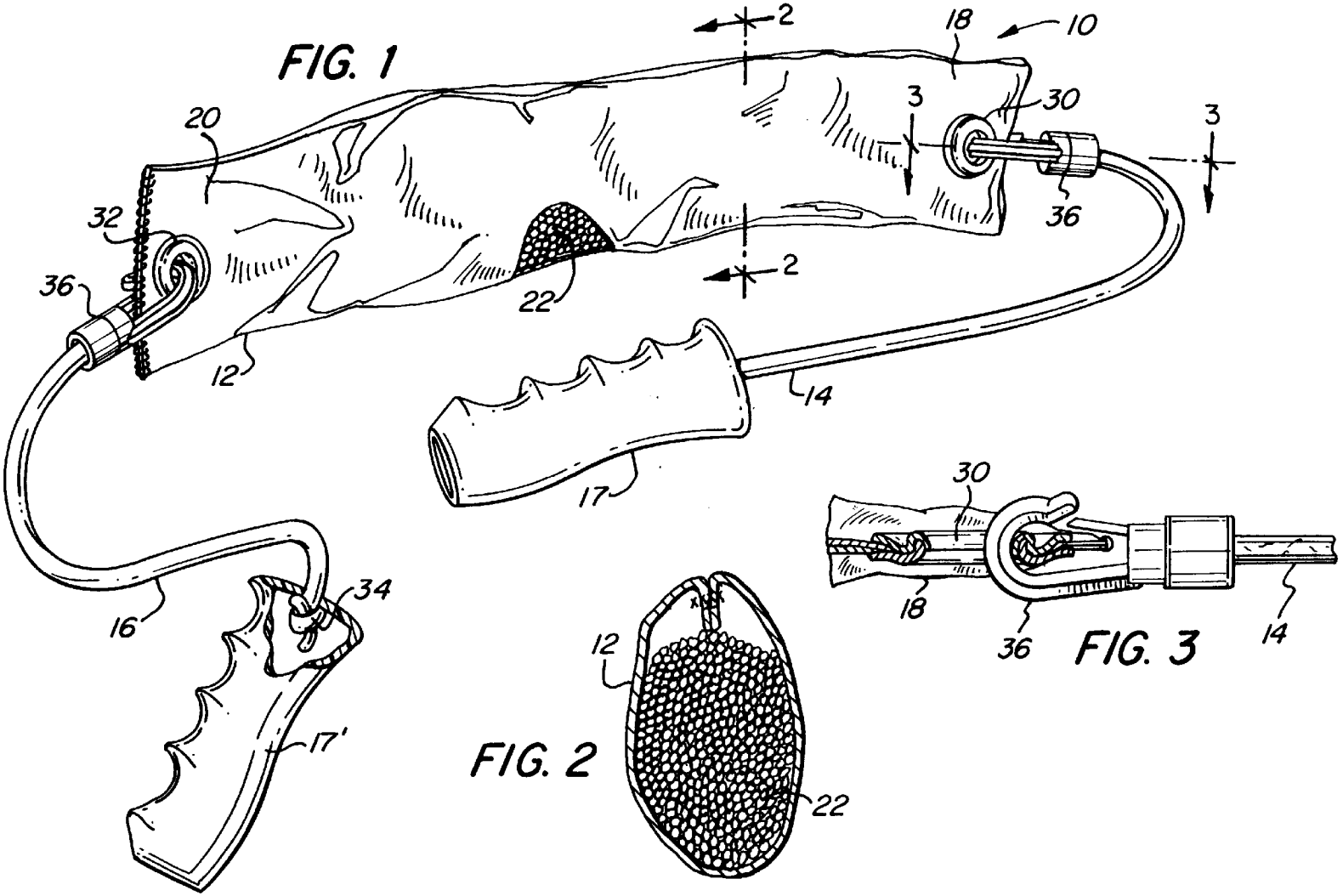
FIG. 1 is a perspective partially broken away view of a cervical support in accordance with the invention.
FIG. 2 is a section view taken along the line 2—2 of the cervical support shown in FIG. 1.
FIG. 3 is an enlarged partial section view taken along the line 3—3 in FIG. 1 of an end segment of a flexible bag used in the cervical support shown in FIG. 1.

With reference to the Figures a cervical support 10 in accordance with the invention is shown formed of a flexible elongate bag 12 and a pair of hand holds in the form of flexible straps 14, 16 connected to end segments 18, 20 of the bag 12 and to handles 17, 17'. The elongate bag contains a granular material 22 which is selected for its ability to conform to the cervical spine when the bag 12 is put in use.

The bag 12 as shown in FIG. 2 is but partially filled with the granular material so that the material can move around to adjust to a person's cervical spine shape and provide area support therefor. Preferably, however, the bag 12 is packed with the granular material to fill the bag while enabling the material to adjust itself and conform to the cervical during abdominal exercises. When filled with a granular material the bag 12 takes on a generally cylindrical shape.

The degree to which the bag is filled can vary. Too much may stiffen the support so as to interfere with its ability to conform to the shape of the cervical while too little tends to reduce the available support. Depending upon the characteristics of the material within the bag 12 the degree of fill may range from about 30% to about 100% of the volume of a bag 12 whose empty length is of the order of about 15 inches and empty flat width is about three and a half inches and when filled is about two and half inches in diameter. With some granular fill materials the percentage of fill can be in the range from about 30% to about 70%. The percentage of fill of the elongate bag varies with bag length since, for certain fill materials, if the bag is long enough some of its end portions that are not in supportive contact with the cervical need not contain much granular fill material.

The granular material can be selected from a large variety of available materials and has certain preferred characteristics for good cervical spine support. The granular material should not be so small as to be easily compactible while its particles should not be so large as not to be able to flow to the sides to conform to the cervical spine with comfort to the person. The granular material preferably, but not necessarily, should be light weight for ease of handling and be made of particles that can move with sufficient ease with respect to each other so as to be able to conform to the shape of a person's cervical spine.

The cross-sectional dimensions of the particles of the granular material can, for example, be predominantly in the range from about 1/32 to about 1/4 of an inch and generally less than 3/4 of an inch commensurate with the above mentioned characteristics.

One granular material suitable for a cervical support in accordance with the invention is formed of ground plastic particles whose cross-sectional dimensions are predominantly in the range from about 1/8 to about 1/4 of an inch. Another preferable material is formed of an organic material such as from dried crushed corn cobbs which tends to be light in weight, has air space between the particles and is not overly solid. The particles typically fall predominantly in the cross-sectional dimensional range from about 1/32 to about 1/16 of an inch with some smaller dust and larger particles so as to form an airy filler with little tendency to excessively compact. Use of the corn cobb derivative material preferably involves filling of the bag 12 to close to its full 100% volume level.

Other materials which can be used are pebbles, provided these do not make the support too heavy and can move to conform to the shape of the cervical spine, sand of sufficient flowability and resistance to compacting, pellets of leather or other materials such as alloys or polymers. Organic materials can be used such as buckwheat hulls, rice or popcorn kernels provided that the flexible enclosure is sufficiently water tight to prevent wetting of the contents from sweat and do not deteriorate with time. A viscous material can be for example a gel used in ice packs.

In one cervical spine support 10 in accordance with the invention a bag 12 with dimensions as set forth above was partially filled to a level of about 50% of the available volume with ground plastic particles. In another preferred form of the invention the bag was filled with a dried crushed corn cobb material.

The bag 12 was made of a substantially water resistant nylon material with grommets 30, 32 placed at the end sections 18, 20. The straps 14,16 were connected to conventional hollow handles 17,17' respectively. Knots 34 were formed in the straps 14, 16 inside the handles 17, 17'. The knots can be moved to adjust the lengths of the straps 14,16. Conventional removable plastic catches 36 were attached to the other ends of the straps 14, 16 for engagement with grommets 30, 32.

The bag 12 can be made of a variety of materials other than nylon such as neoprene. Preferably the bag 12 is made of a sweat resistant material.

Figure 5:
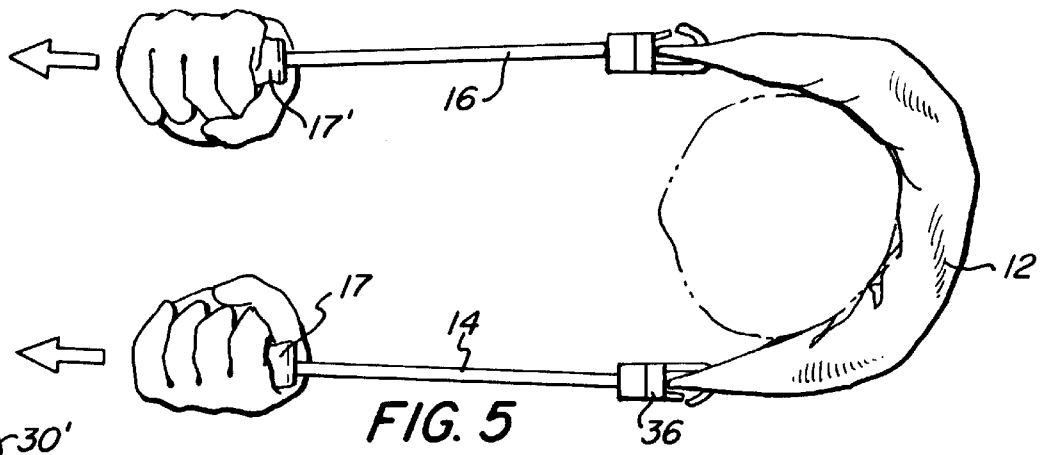
FIG. 5 is a top view of the person showing the use of the cervical support of FIG. 1.
Figure 4:
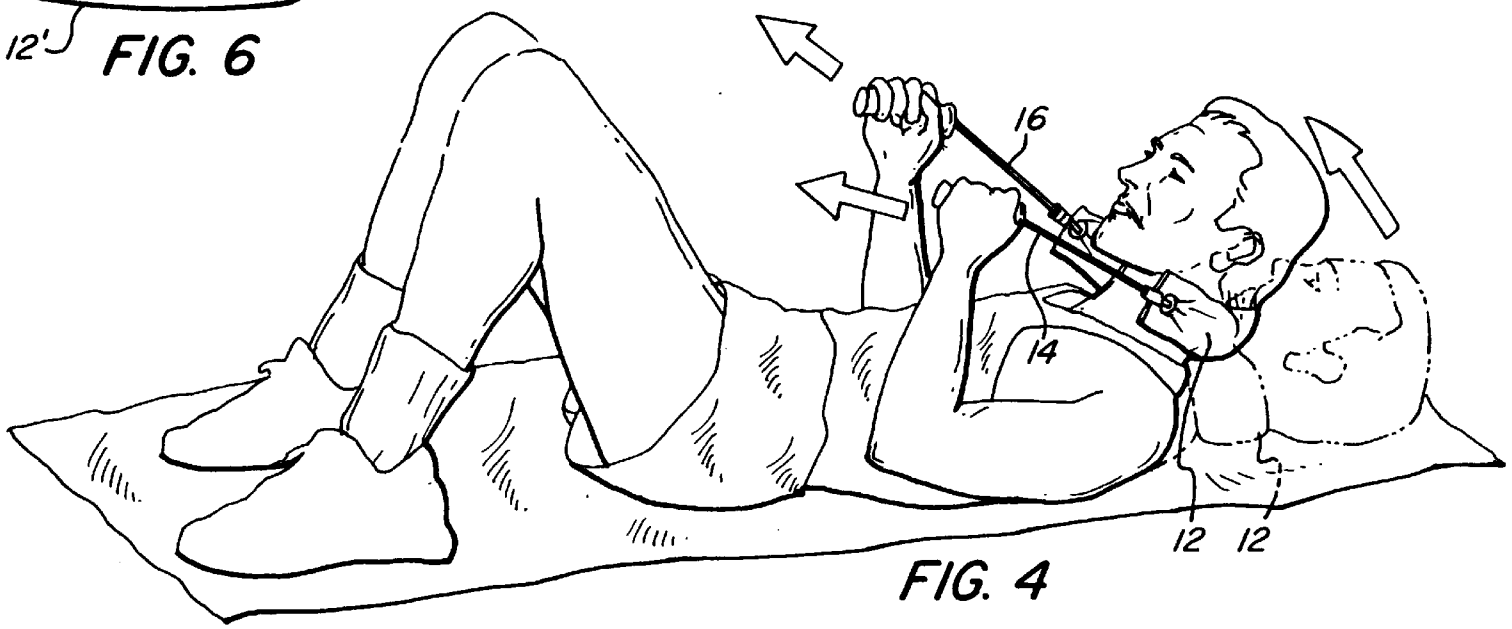
FIG. 4 is a perspective view of a person using a cervical support of FIG. 1 in accordance with the invention.

FIGS. 4 and 5 illustrate the use of a cervical support 10 in accordance with the invention. The support comfortably wraps around the cervical spine during situp exercises and is conveniently held.

Figure 6:
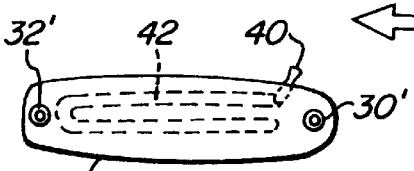
FIG. 6 is a plan view of a cervical support in which air is used to provide conformability.

FIG. 6 shows a flexible bag 12' formed of an air impervious material and having an air inflation valve 40. The bag 12' can be formed of welded vinyl sheets and the valve is a standard inflation valve operatively connected to an air retaining channel 42.

Having thus described a cervical support in accordance with the invention its advantages can be appreciated. Variations can be made from the described embodiment without departing from the scope of the invention as determined by the following claims.

What is claimed is:

1. A flexible cervical spine support for use in assisting in the performance of abdominal exercises, comprising: an elongate hollow flexible, substantially non stretchable, singular bag of sufficient cross sectional dimension and containing filler material consisting of granular particles within a predetermined size range so as to form, in the aggregate, a rigid conformable non-compactable structure that enables the bag to conform to the shape of a person's cervical including it's lordosis to provide a conforming rigid support for the cervical during abdominal exercises; and substantially non-stretchable hand hold means affixed to end segments of the elongate flexible singular bag for enabling a person to manually hold the flexible bag in cervical spine support relationship during abdominal exercises.

2. A flexible cervical spine support as claimed in claim 1 wherein the granular material has particle sizes selected so as to avoid excessive compacting of the granular material and so as to enable the bag to conform with comfort to the shape of a the cervical spine of a person.

3. A flexible cervical spine support as claimed in claim 2 wherein cross-sectional dimensions of particles of the granular material are predominantly in the range from about one thirty-second to about three quarter of an inch.

4. A flexible cervical spine support as claimed in claim 3 wherein the cross-sectional dimensions of the particles of the granular material are predominantly less than one quarter of an inch.

5. A flexible cervical spine support as claimed in claim 1 wherein the light weight granular material is formed of ground plastic particles.

6. A flexible cervical spine support as claimed in claim 1 wherein the light weight granular material is formed of dried crushed corn cobbs.

7. A flexible cervical spine support as claimed in claim 6 wherein cross-sectional dimensions of the dried crushed corn cobb material are selected so as to avoid excessive compacting of the granular material and are so as to enable the bag to conform with comfort to the shape of the cervical spine of a person.

8. A flexible cervical spine support as claimed in claim 7 wherein the cross-sectional dimensions are selected to be predominantly in the range from about one thirty-second to generally less than three quarter of an inch.

9. A flexible cervical spine support as claimed in claim 8 wherein the cross-sectional dimensions are selected to be predominantly in the range from about one thirty-second to generally less than one quarter of an inch.

10. A flexible cervical spine support as claimed in claim 9 wherein the cross-sectional dimensions of the particles of the granular material are predominantly less than about one eighth of an inch.

11. A flexible cervical spine support as claimed in claim 1 wherein the bag is partially filled with said granular material.

12. A flexible cervical spine support for use in assisting in the performance of abdominal exercise, comprising:

a substantially non-stretchable elongate singular flexible bag having a crossection selected to provide cervical support and containing a filler material consisting of a loose granular material; wherein the granular material has particle sizes selected in a range so as to avoid excessive compacting of the granular material while imparting sufficient rigidity without compactability so as to enable the singular flexible bag to conform with comfort to the shape of the cervical spine of a person; and non-stretchable hand hold means affixed to end segments of the elongate flexible bag for enabling a person to manually hold the flexible bag in cervical spine support relationship during abdominal exercises.

13. A flexible cervical spine support as claimed in claim 12 wherein the non-stretchable hand hold means includes flexible straps whose lengths are adjustable to fit a person.

14. A flexible cervical spine support for use in assisting in the performance of abdominal exercises, comprising:

an elongate flexible substantially non-stretchable singular bag having a crossectional shape selected to provide cervical support and containing a filler material consisting of a loose granular material; wherein the granular material is formed of a dried crushed corn cob material with particle sizes selected so as to avoid excessive compacting of the granular material and so as to enable the bag to conform with rigid non compactable comfort to the shape of a back of the cervical spine of a person; and wherein the granular material is further selected so as to enable particles in the granular material to slide relative to one another to adjust to the lordosis of the cervical; and substantially non-stretchable hand hold means affixed to end segments of the elongate flexible singular bag for enabling a person to manually hold the flexible bag in cervical spine support relationship while the granular material inside the bag conforms to the shape of the cervical spine during abdominal exercises.

* * * * *